US005905228A

United States Patent [19]

Bisping et al.

[11] Patent Number: 5,905,228

[45] Date of Patent: May 18, 1999

[54] METHOD FOR THE MANUFACTURE OF A SUBCALIBER PROJECTILE MANUFACTURED WITH THIS METHOD

[75] Inventors: Bernhard Bisping, Ratingen; Jürgen Kolodzey, Fassberg; Wolfgang Stein, Hermannsburg; Alfons Sackarndt, Neulutterloh, all of Germany

[73] Assignee: Rheinmetall Industrie AG, Ratingen, Germany

[21] Appl. No.: 08/984,108

[22] Filed: Dec. 3, 1997

[30] Foreign Application Priority Data

Dec. 6, 1996 [DE] Germany ..... 196 50 741

[51] Int. Cl.[6] ..... F42B 14/06

[52] U.S. Cl. ..... 102/521; 29/1.23; 86/1.1

[58] Field of Search ..... 102/520–523; 29/1.2, 1.22, 1.23; 86/1.1

[56] References Cited

U.S. PATENT DOCUMENTS

| | | | |
|---|---|---|---|
| 3,446,147 | 5/1969 | Engel et al. | 102/522 |
| 4,719,860 | 1/1988 | Ruffle et al. | 102/521 |
| 5,052,305 | 10/1991 | Chiarelli et al. . | |

FOREIGN PATENT DOCUMENTS 2 299 155 9/1996 United Kingdom .

*Primary Examiner*—Harold J. Tudor

*Attorney, Agent, or Firm*—Venable; Norman N. Kunitz

[57] ABSTRACT

A method for the manufacture of a subcaliber projectile as well as a projectile (1) which is formed according to the method and which comprises a penetrator (2), a propelling cage (3) surrounding the central or mid-portion of the penetrator, and a plastic cap (5) that is arranged on the front of the propelling cage (3) and is conically tapered toward the penetrator point (4). For an easy and cost-effective way of manufacturing the connection between the plastic cap (5) and the propelling cage (3), according to the invention a thermoplastic synthetic material is used as the material for the cap (5), and the plastic cap (5) is attached by ultrasonic welding to the propelling cage (3). For this purpose, the plastic cap (5) is heated at certain points along its circumference, in at least two different partial regions (11), and is formed or molded into a groove-shaped recess (9) provided on the outer surface of the forward region of the propelling cage and covered by a rear portion of the cap, such that the knob-shaped, inward-pointing regions (12) of the plastic cap (5) resulting from the heating engage form-fittingly in the groove-shaped recess (9) of the propelling cage (3).

5 Claims, 1 Drawing Sheet

METHOD FOR THE MANUFACTURE OF A SUBCALIBER PROJECTILE MANUFACTURED WITH THIS METHOD

BACKGROUND OF THE INVENTION

The invention relates to a method for manufacturing a subcaliber projectile which comprises a penetrator having a point at its front end, a propelling cage surrounding a portion of the penetrator, and a plastic cap arranged on a front end of the propelling cage and being tapered conically toward the penetrator point. The invention furthermore relates to a subcaliber projectile formed according to the method of the invention.

Subcaliber projectiles of the above-mentioned type are used in particular for firing from automatic weapons. Such projectiles comprise a penetrator having a point at its front end, a propelling cage surrounding the midportion of the penetrator, and a plastic cap that is conically tapered toward the penetrator point and is arranged or mounted on the front of the propelling cage. The plastic cap, also called a feeding cap, is designed to facilitate the automatic supply of the respective cartridge to the weapon chamber, as well as to protect the penetrator point and the propelling cage of the projectile. The placing of groove-shaped predetermined break locations extending in a longitudinal direction of the projectile on the surface of the feeding cap will cause a defined cracking of the feeding cap, in particular with spin-stabilized projectiles, while the projectile moves through the weapon or gun tube or after moving through the gun tube and directly in front of the tube muzzle, so that the respective segments of the feeding cap fly off to the side as soon as the projectile has left the tube.

With known projectiles, the plastic cap is attached to the front region of the propelling cage of either a snap-on connection arrangement, an adhesive or a screw connection. These known fastening methods have a number of disadvantages.

One such drawback with regard to the snap-on connection is that following the injection-molding of the plastic cap, a relatively involved mechanical reworking of the cap is thus still necessary. In addition, the plastic cap for the snap-on connection is already overstretched during the assembly and thus can crack along its predetermined break grooves. If the feeding cap is made of a very ductile material to prevent such a cracking, then the predetermined break locations do not crack all of a sudden in front of the tube muzzle, as desired, which lowers the hit accuracy considerably. The feeding strength of such caps therefore, as a rule, does not satisfy the requirements they are expected to meet.

The realizing of adhesive connections is also relatively involved. An additional problem with such a connection is that a nonuniform separation of the cap segments occurs, owing to the frequently somewhat different adhesion between cap and propelling cage. This often has a negative influence on the hit probability of the penetrator.

Finally, the connection with screws is also very involved. In addition, screw connections, as a rule, lead to a weakening of the cross sections for cap and propelling cage.

It is the object of the present invention to provide a method for a simple and cost-effective connection between the plastic cap and the propelling cage, wherein a good and secure feeding must be ensured for the respective projectile during the firing with automatic weapons, as well as a good hit capability. Furthermore, a subcaliber projectile manufactured in accordance with this method is to be provided.

SUMMARY OF THE INVENTION

The above object generally is achieved with respect to the method according to the present invention by a method for manufacturing a subcaliber projectile which comprises a penetrator having a point at its front end, a propelling cage surrounding a portion of the penetrator, and a plastic cap arranged on a front end of the propelling cage and being tapered conically toward the penetrator point, with the method comprising the steps of:

providing a reduced diameter front region of the propelling cage with at least one groove-shaped recess that extends from the outer circumferential surface of the propelling cage in the front region toward the inside of the propelling cage:

forming the plastic cap of a thermoplastic synthetic material, and pushing the plastic cap over the front region of the propelling cage such that the groove-shaped recess is covered by the cap;

heating the plastic cap at points in at least two different partial segments of the circumferential surface to cause the material of the cap in said partial segments to form inward-pointing knob-shaped regions on the interior surface of the plastic cap which extend into the groove-shaped recess of propelling cage and engage form-fittingly in the groove-shaped recess.

Moreover, the above object is achieved according to the invention by a subcaliber projectile which comprises: a penetrator having a point at its front end; a propelling cage surrounding a midportion of the penetrator; and a plastic cap that is arranged on the front of the propelling cage and is conically tapered toward the penetrator point; and wherein the propelling cage has at least one groove-shaped recess in its front region, which groove extends from the outer circumferential surface of the propelling cage toward the inside of the propelling cage; a rear portion of the plastic cap covers the front region of the propelling cage; and, in at least two partial regions along the circumference of the inner surface of the plastic cap, the plastic cap has respective knob-shaped, inward-pointing projections formed by localized heating of the plastic cap material, which projections are molded into the groove-shaped recess of the propelling cage and engage form-fittingly in the groove-shaped recess.

Further advantageous embodiments and features of the invention are disclosed and described.

The invention essentially is based on the idea of using a thermoplastic synthetic material for the cap and ultrasound welding for attaching the plastic cap to the propelling cage. For this, the plastic cap is heated at certain points, in at least two partial regions of the circumference, with ultrasonic welding, and is formed or molded into a groove-shaped recess in the outer surface of the propelling cage such that the resulting regions of the plastic cap at the heated points, which regions have a knob or nub shape and are facing inward, engage form-fittingly in the groove-shaped recess of the propelling cage.

The feeding cap therefore no longer has to be reworked mechanically, following the injection-molding, not even on the inside, at the contact zone with the propelling cage. Owing to this type of feeding cap and the way it is connected to the propelling cage, the otherwise necessary ring-shaped holding band at the front of the propelling cage, which holds together the propelling cage segments during the transport, for example, becomes unnecessary.

A safe connection between the propelling cage and the plastic cap can be established in a very simple way if the groove-shaped recess is an annular groove.

Further details and advantages of the invention result from the following embodiments, explained with the aid of figures.

DETAILED DESCRIPTION OF THE PREFERRED EMBODIMENT

Figure 1:
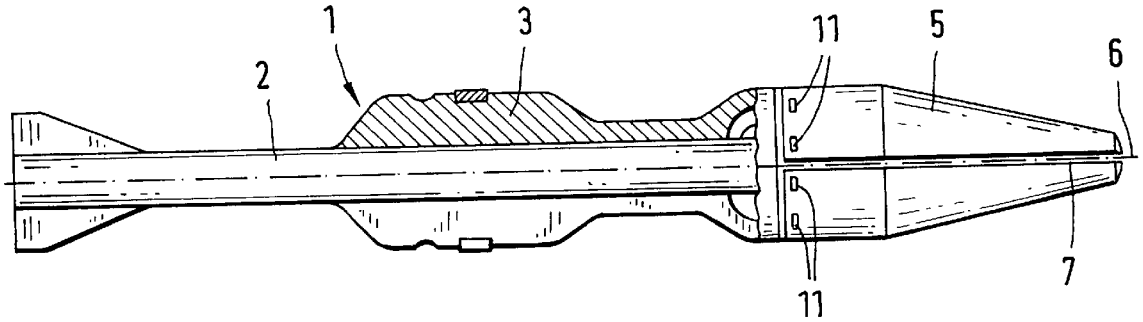
FIG. 1 is a side view, partially in longitudinal section, of a projectile according to the invention with feeding cap.
Figure 2:
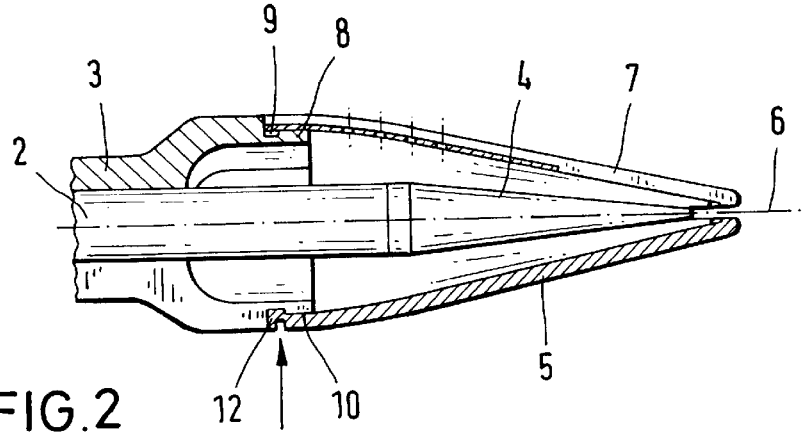
FIG. 2 is a longitudinal sectional view of the enlarged point region of the projectile displayed in FIG. 1.

Referring now to the figures, FIG. 1 shows a subcaliber projectile 1, which essentially comprises a penetrator 2, a propelling cage 3 that consists of several droppable or separatable segments, and a feeding cap 5 of a thermoplastic synthetic material, which adjoins and is connected to the front of the propelling cage 3, and is tapered toward the tip of the penetrator point 4 as shown in FIG. 2. The feeding cap 5 preferably has four predetermined break grooves 7, which are distributed evenly over the outer circumferential surface of the cap 5 and extend in the direction of the longitudinal axis 6 of the projectile 1.

As can be seen in FIG. 2, the rear region of the feeding cap 5 is pushed onto or over a front region 8 of the propelling cage 3, wherein the outside diameter for the propelling cage 3 in this region 8 is smaller than the caliber of the projectile. The propelling cage 3 also has a ring shaped or annular groove 9 in its outer surface 10 of its front region 8, which groove 9 extends radially from the outer circumferential surface 10 of the front region 8 of propelling cage 3 toward the inside of the propelling cage and is covered by the plastic cap 5.

Two respective partial regions 11 of the plastic cap 5 are provided in the circumferential direction between neighboring predetermined break grooves 7. Within these regions 11, knob or nub shaped, inward-pointing regions or projections 12 of the plastic cap 5 engage form-fittingly in the annular groove 9 of the propelling cage 3 as can be seen in FIG. 2, thereby securing the plastic cap 5 with respect to the propelling cage 3.

According to the method of the invention, the inwardly directed or pointing projections 12 are not formed initially on the cap 5 during formation or molding of the cap 5, but rather are formed by heating the regions 11 using ultrasonic welding. In particular, in accordance with the invention, the knob-shaped regions 12 are not fitted into the ring groove 9 with the aid of ultrasonic welding until the plastic cap 5 has been pushed over the front region 8 of the propelling cage 3. Consequently, there is no fear of an overstretching of the rear region of plastic cap 5 which is facing the region 8 of the propelling cage 3. This is in contrast to a snap-on connection.

Of course, the invention is not limited to the above-described embodiment. Thus, the number of predetermined break grooves may be higher or smaller than four. Also, the number of partial regions 11 between two respectively neighboring predetermined break grooves 7 can be smaller or higher than two.

The invention now being fully described, it will be apparent to one of ordinary skill in the art that many changes and modifications can be made thereto without departing from the spirit or scope of the invention as set forth herein.

What is claimed:

1. A method for manufacturing a subcaliber projectile which comprises a penetrator having a point at its front end, a propelling cage surrounding a portion of the penetrator, and a plastic cap arranged on a front end of the propelling cage and being tapered conically toward the penetrator point, said method comprising the steps of:

providing a reduced diameter front region of the propelling cage with at least one groove-shaped recess that extends from the outer circumferential surface of the propelling cage in the front region toward the inside of the propelling cage;

forming the plastic cap of a thermoplastic synthetic material, and pushing the plastic cap over the front region of the propelling cage such that the groove-shaped recess is covered by the cap;

heating the plastic cap at points in at least two different partial segments of the circumferential surface to cause the material of the cap in said partial segments to form inward-pointing knob-shaped regions ion the interior surface of the plastic cap which extend into the groove-shaped recess of propelling cage and engage form-fittingly in the groove-shaped recess.

2. A method according to claim 1, wherein the groove-shaped recess is an annular groove.

3. A method according to claim 2, wherein the plastic cap has several predetermined break grooves in its outer surface that are distributed evenly over the circumference of the cap and extend in the direction of the longitudinal axis of the projectile; and said step of heating includes heating the plastic cap in different partial segments to form at least two knob-shaped regions which extend into the groove-shaped recess of propelling cage between each pair of neighboring predetermined break grooves.

4. A subcaliber projectile comprising: a penetrator having a point at its front end; a propelling cage surrounding a midportion of the penetrator; and a plastic cap that is arranged on the front of the propelling cage and is conically tapered toward the penetrator point; and wherein the propelling cage has at least one groove-shaped recess in its front region, which groove extends from the outer circumferential surface of the propelling cage toward the inside of the propelling cage; a rear portion of the plastic cap covers the front region of the propelling cage; and, in at least two partial regions along the circumference of the inner surface of the plastic cap, the plastic cap has respective knob-shaped, inward-pointing projections formed by localized heating of the plastic cap material, which projections are molded into the groove-shaped recess of the propelling cage and engage form-fittingly in the groove-shaped recess.

5. A subcaliber projectile according to claim 4 wherein the recess is an annular groove.

* * * * *

UNITED STATES PATENT AND TRADEMARK OFFICE

CERTIFICATE OF CORRECTION

PATENT NO. : 5,905,228

DATED : May 18, 1999

INVENTOR(S) : Bernhard Bisping, et al.

It is certified that error appears in the above-indentified patent and that said Letters Patent is hereby corrected as shown below:

On the title page, item [56] insert the following:

U. S. PATENT DOCUMENTS

| EXAMINER INITIAL | | PATENT NUMBER | | | | | | | ISSUE DATE | PATENTEE | CLASS | SUBCLASS | FILING DATE IF APPROPRIATE |
|---|---|---|---|---|---|---|---|---|---|---|---|---|---|
| | | 4 | 7 | 7 | 7 | 2 | 8 | 0 | 10.11.88 | BURRI, et al. | | | |
| | | | | | | | | | | | | | |

FOREIGN PATENT OR PUBLISHED FOREIGN PATENT APPLICATION

| | | DOCUMENT NUMBER | | | | | | | PUBLICATION DATE | COUNTRY OR PATENT OFFICE | CLASS | SUBCLASS | TRANSLATION YES | TRANSLATION NO |
|---|---|---|---|---|---|---|---|---|---|---|---|---|---|---|
| | | CH | 5 | 9 | 8 | 5 | 6 | 2 | 4.28.78 | SWITZERLAND | | | | NO |
| | | 0 | 1 | 0 | 4 | 5 | 8 | 7 | 4.04.84 | EPO | | | | YES |
| | | 1 | 5 | 7 | 8 | 1 | 9 | 1 | 5.19.71 | GERMANY | | | | NO |
| | | 2 | 6 | 4 | 2 | 1 | 6 | 1 | 7.27.90 | FRANCE | | | | NO |
| | | 2 | 7 | 1 | 1 | 7 | 8 | 5 | 5.05.95 | FRANCE | | | | NO |
| | | DE | 4 | 2 | 1 | 5 | 304 | C2 | 11.18.93 | GERMANY | | | | NO |
| | | CH | 3 | 0 | 5 | 1 | 5 | 0 | 4.16.55 | SWITZERLAND | | | | NO |
| | | CH | 4 | 7 | 6 | 9 | 7 | 1 | 9.30.69 | SWITZERLAND | | | | NO |

Signed and Sealed this

Twenty-sixth Day of October, 1999

*Attest:*

Q. TODD DICKINSON

*Attesting Officer*

*Acting Commissioner of Patents and Trademarks*